US010576752B2

(12) United States Patent
Matsusaki

(10) Patent No.: US 10,576,752 B2
(45) Date of Patent: Mar. 3, 2020

(54) THERMAL HEAD AND THERMAL PRINTER

(71) Applicant: KYOCERA Corporation, Kyoto-shi, Kyoto (JP)

(72) Inventor: Yuuki Matsusaki, Kirishima (JP)

(73) Assignee: KYOCERA CORPORATION, Kyoto-Shi (JP)

( * ) Notice: Subject to any disclaimer, the term of this patent is extended or adjusted under 35 U.S.C. 154(b) by 0 days.

(21) Appl. No.: 16/088,962

(22) PCT Filed: Mar. 29, 2017

(86) PCT No.: PCT/JP2017/013121
§ 371 (c)(1),
(2) Date: Sep. 27, 2018

(87) PCT Pub. No.: WO2017/170800
PCT Pub. Date: Oct. 5, 2017

(65) Prior Publication Data

US 2019/0111705 A1 Apr. 18, 2019

(30) Foreign Application Priority Data

Mar. 29, 2016 (JP) ..... 2016-066669

(51) Int. Cl.
*B41J 2/33* (2006.01)
*B41J 2/335* (2006.01)

(52) U.S. Cl.
CPC ..... *B41J 2/3351* (2013.01); *B41J 2/3353* (2013.01); *B41J 2/3355* (2013.01); *B41J 2/33535* (2013.01); *B41J 2/33515* (2013.01)

(58) Field of Classification Search
CPC .... B41J 2/3357; B41J 2/3354; B41J 2/33525; B41J 2/3359; B41J 2/335; B41J 2/33505; B41J 2/3353
See application file for complete search history.

(56) References Cited

U.S. PATENT DOCUMENTS 5,162,814 A 11/1992 Shirakawa et al.

FOREIGN PATENT DOCUMENTS

| | | | |
|---|---|---|---|
| JP | 04-028567 | A | 1/1992 |
| JP | 04-232762 | A | 8/1992 |
| JP | 05-008418 | A | 1/1993 |
| JP | 2004-114633 | A | 4/2004 |

*Primary Examiner* — Kristal Feggins
(74) *Attorney, Agent, or Firm* — Volpe and Koenig, P.C.

(57) ABSTRACT

A thermal head of the present disclosure includes a substrate, a heating part, an electrode, a protection layer, and a coating layer made of a resin material. The heating part is placed on or above the substrate. The electrode is placed on or above the substrate and connected to the heating part. The protection layer is placed on or above the heating part and the electrode. The coating layer is placed on or above the electrode and the protection layer. The protection layer includes a recessed part that is opened on an upper surface and that extends along a thickness direction of the protection layer. The recessed part includes an inner wall having a plurality of recesses and projections, and the resin material is disposed inside the recessed part.

10 Claims, 7 Drawing Sheets

THERMAL HEAD AND THERMAL PRINTER

CREOSS-REFERENCE TO RELATED APPLICATIONS

This application is national stage application of International Application No. PCT/JP2017/013121, filed on Mar. 29, 2017, which designates the United States, incorporated herein by reference, and which claims the benefit of priority from Japanese Patent Application No. 2016-066669, filed on Mar. 29, 2016, the entire contents of which are incorporated herein by reference.

FIELD

The embodiments disclosed herein relate to a thermal head and a thermal printer.

BACKGROUND

Conventionally, various thermal heads have been developed as a printing device for a facsimile, a video printer, and the like. For example, a thermal head in which a part of a protection layer for protecting a heating part and an electrode provided on a substrate are covered by a resin layer has been known (for example, see Patent Literatures 1 and 2).

CITATION LIST

Patent Literature

Patent Literature 1: Japanese Patent Application Laid-open No. H04-28567

Patent Literature 2: Japanese Patent Application Laid-open No. H05-8418

SUMMARY

A thermal head according to an aspect of embodiments includes a substrate, a heating part, an electrode, a protection layer, and a coating layer made of a resin material. The heating part is placed on or above the substrate. The electrode is placed on or above the substrate and connected to the heating part. The protection layer is placed on or above the heating part and the electrode. The coating layer is placed on or above the electrode and the protection layer, and made of a resin material. The protection layer includes a recessed part that is opened on an upper surface and that extends along a thickness direction of the protection layer. The recessed part includes an inner wall having a plurality of recesses and projections, and the resin material is disposed inside the recessed part.

DESCRIPTION OF EMBODIMENTS

Hereinafter, embodiments of a thermal head and a thermal printer disclosed in the present application will be described in detail with reference to the accompanying drawings.

<First Embodiment>

Figure 1:
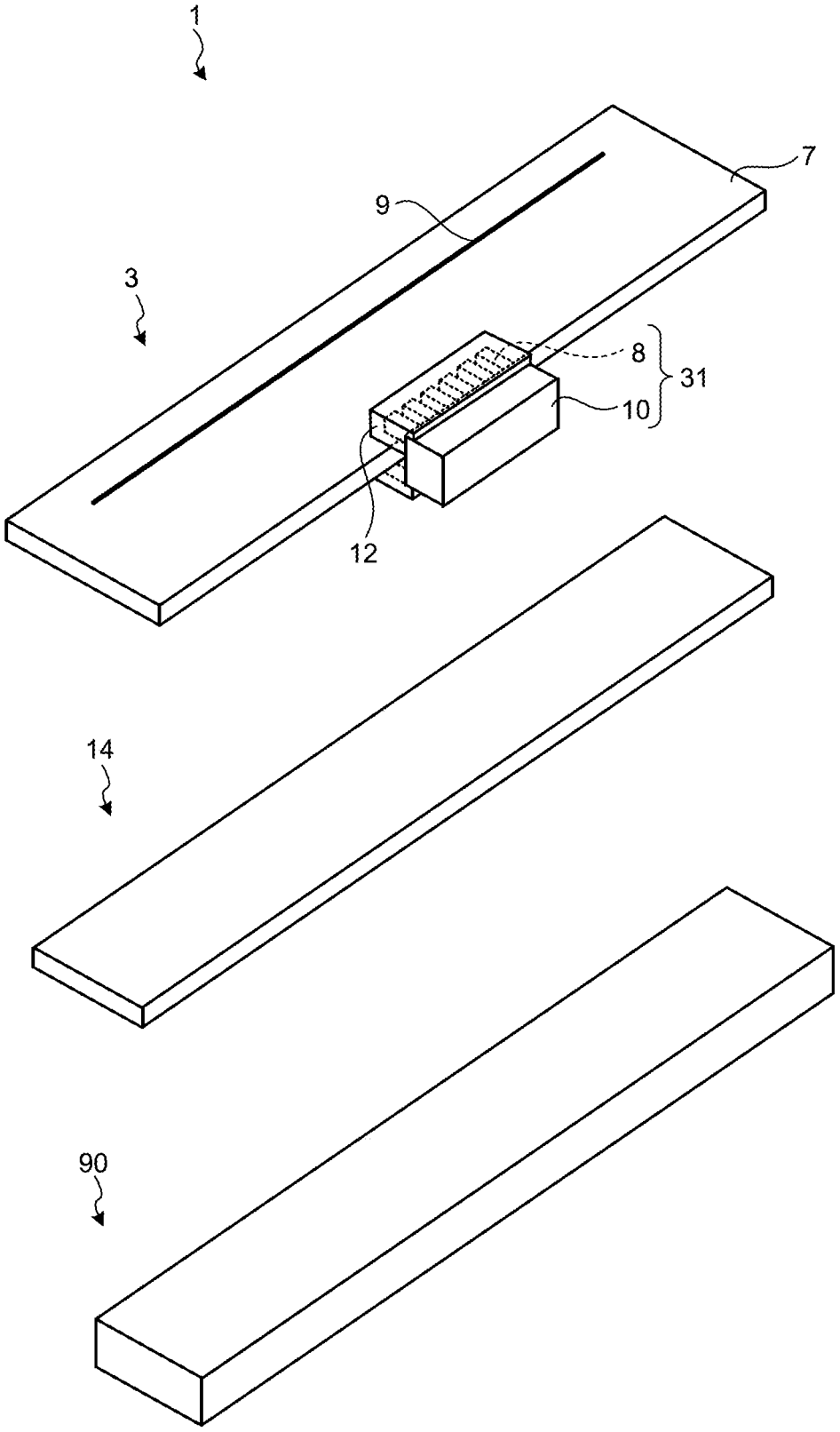
FIG. 1 is an exploded perspective view illustrating an outline of a thermal head according to a first embodiment.

FIG. 1 is a schematic configuration of a thermal head according to a first embodiment. A thermal head 1 illustrated in FIG. 1 includes a head base body 3, a heat sink 90, a bonding member 14, a connector 31, and a sealing member 12.

The head base body 3 is formed in a substantially rectangular parallelepiped shape, and is mounted on the heat sink 90 with the bonding member 14 interposed therebetween. Members that configure the thermal head 1 are provided on a substrate 7 of the head base body 3. The head base body 3 heats a heating part 9 and performs printing on a recording medium, by applying voltage to the heating part 9 according to an electrical signal supplied from the outside via the connector 31. The members that configure the thermal head 1 will be described below with reference to FIG. 2 and FIG. 3, and the recording medium will be described below with reference to FIG. 5.

The connector 31 is joined to the head base body 3 by the sealing member 12, and electrically connects the outside with the head base body 3. The bonding member 14 bonds the head base body 3 with the heat sink 90. The heat sink 90 is formed in a rectangular parallelepiped shape, and provided to radiate heat of the head base body 3. For example, the heat sink 90 is formed of a metal material such as copper, iron, aluminum, or the like, and has a function of radiating heat that does not contribute to printing, among the heat generated in the heating part 9 of the head base body 3.

Figure 2:
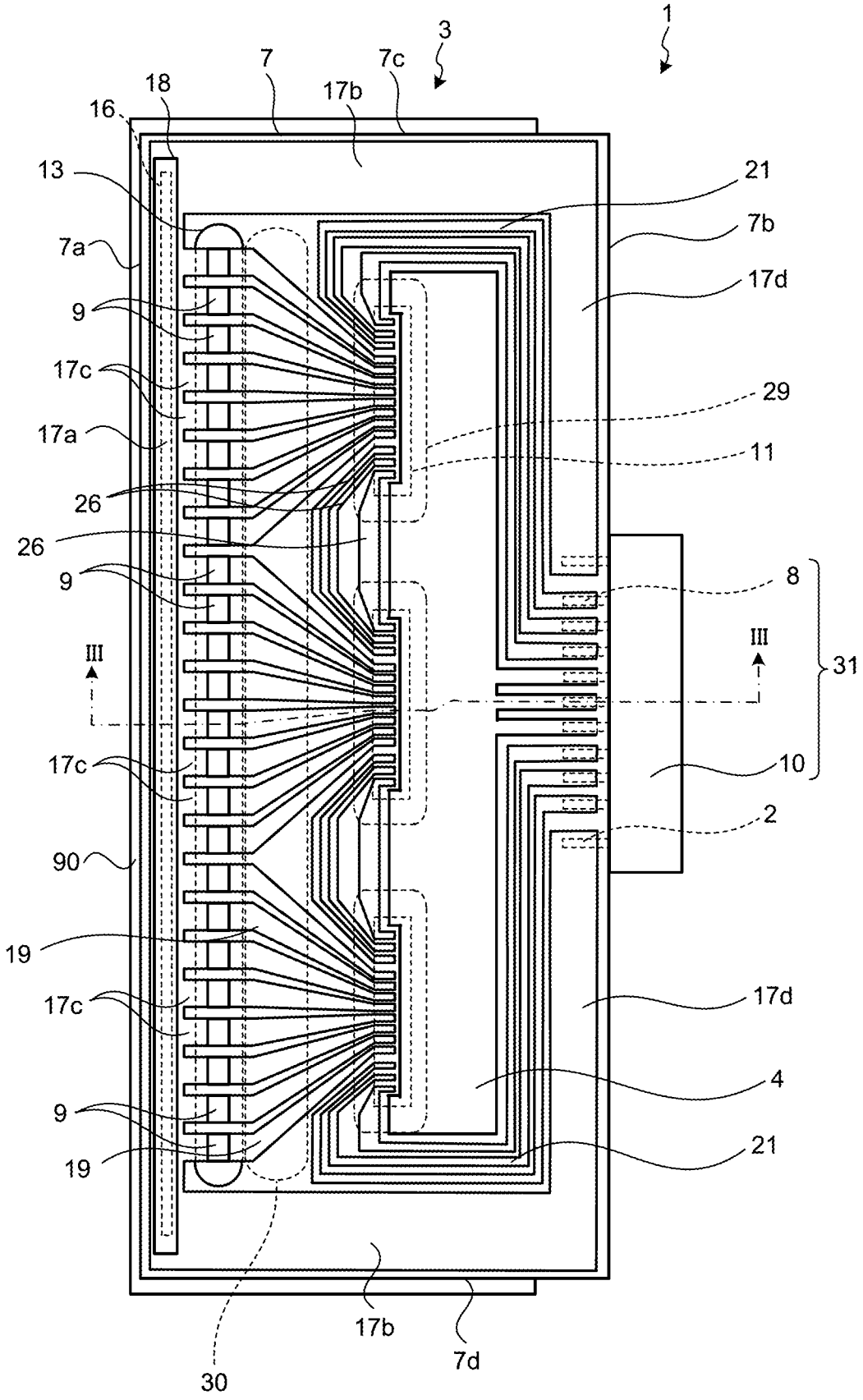
FIG. 2 is a plan view illustrating an outline of the thermal head illustrated in FIG. 1.
Figure 3:
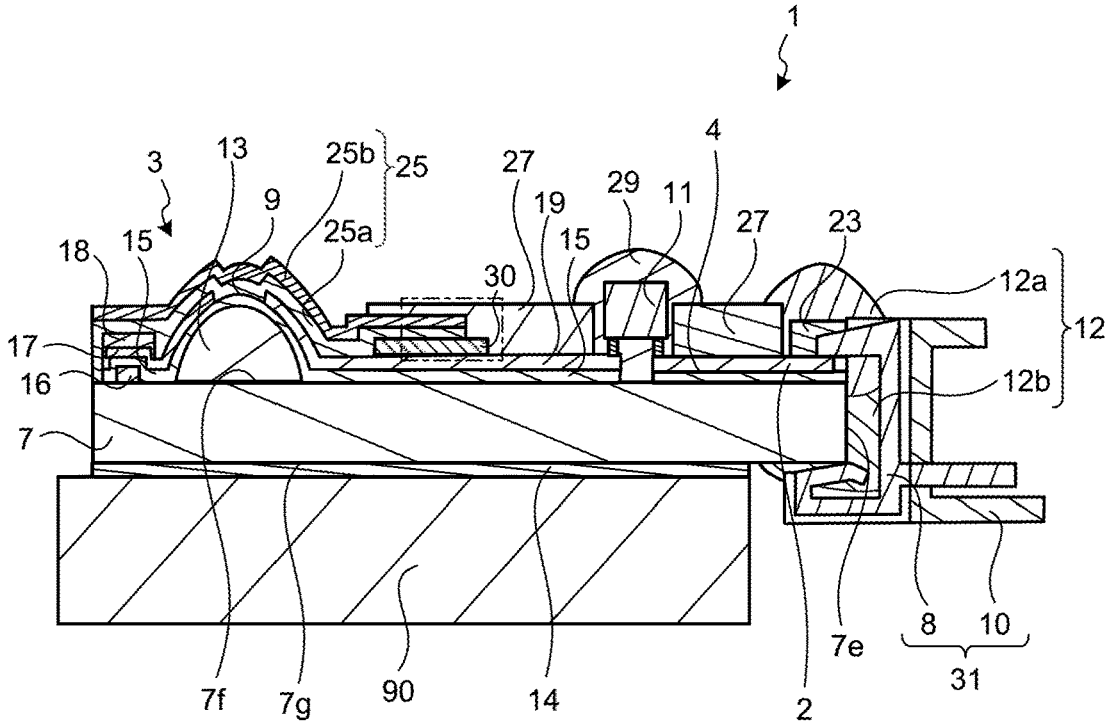
FIG. 3 is a sectional view cut along the line III-III in FIG. 2.

The members that configure the thermal head 1 will be further described with reference to FIG. 2 and FIG. 3. FIG. 2 is a plan view illustrating a schematic configuration of the thermal head 1 illustrated in FIG. 1. FIG. 3 is a sectional view cut along the line III-III in FIG. 2.

The thermal head 1 further includes the substrate 7, a heat storage layer 13, a thick film electrode 16, a resistance layer 15, a common electrode 17, an individual electrode 19, a first connection electrode 21, a ground electrode 4, a connection terminal 2, a second connection electrode 26, a driving integrated circuit (IC) 11, a resin layer 18, a hard coat 29, an insulation layer 30, a protection layer 25, and a coating layer 27. In FIG. 2, illustrations of the sealing member 12, the protection layer 25, and the coating layer 27 are omitted.

The substrate 7 is formed in a rectangular shape in a plan view, and has a first long side 7*a*, a second long side 7*b*, a first short side 7*c*, a second short side 7*d*, a side surface 7*e*, a first surface 7*f*, and a second surface 7*g*. For example, the substrate 7 is formed of an electrical insulating material such as alumina ceramics, a semiconductor material such as single crystal silicon, or the like. Hereinafter, for the sake of convenience, the first surface 7*f* may be referred to as an "upper surface" and the second surface 7*g* may be referred to as a "lower surface". Similarly, the first surface 7*f* side may be referred to as "above" or "upward", and the second surface 7*g* side may be referred to as "below" or "downward" on the basis of the side surface 7*e*.

The connector 31 is provided on the side surface 7*e* of the substrate 7. The connector 31 is fixed to the side surface 7*e* by a connector pin 8, a joining member 23, and the sealing member 12. The joining member 23 has conductivity, and is disposed between the connection terminal 2 and the connector pin 8. An example of the joining member 23 includes solder, anisotropic conductive paste, or the like. A layer (not illustrated) plated by nickel (Ni), gold (Au), or palladium (Pd) may be disposed between the joining member 23 and the connection terminal 2. The joining member 23 need not be necessarily provided.

The connector 31 includes a plurality of connector pins 8 and a housing 10 for storing the connector pins 8. One end of the connector pins 8 is exposed to the outside of the housing 10, and the other end is accommodated inside the housing 10. The connector pins 8 are electrically connected to the connection terminal 2 of the head base body 3, and are electrically connected to various electrodes of the head base body 3.

The sealing member 12 includes a first sealing member 12*a* and a second sealing member 12*b*. The first sealing member 12*a* is placed at the first surface 7*f* side of the substrate 7 and the second sealing member 12*b* is placed at the second surface 7*g* side of the substrate 7. The first sealing member 12*a* is provided in such a manner as to seal the connector pins 8 and the various electrodes. The second sealing member 12*b* is provided in such a manner as to seal the contact portion between the connector pins 8 and the substrate 7.

The sealing member 12 is provided in such a manner that the connection terminal 2 and the connector pins 8 do not expose to the outside. For example, the sealing member 12 may be formed of epoxy-based heat curable resin, ultraviolet light curable resin, or visible light curable resin. The first sealing member 12*a* and the second sealing member 12*b* may be formed of the same material or different materials.

The bonding member 14 is disposed on the heat sink 90, and joins the second surface 7*g* of the substrate 7 and the heat sink 90. An example of the bonding member 14 includes a double-sided tape, a resin adhesive, or the like.

The heat storage layer 13 is provided on the first surface 7*f* of the substrate 7. The heat storage layer 13 extends along the main scanning direction. The cross-section of the heat storage layer 13 is formed in a substantially semi-elliptical shape, and the heat storage layer 13 projects upward from the substrate 7. From a practical viewpoint, for example, it is preferable that the height of the heat storage layer 13 from the substrate 7 is from 15 to 90 μm.

The heat storage layer 13 is formed of a material such as glass having a low thermal conductivity, and has a function of temporarily storing a part of the heat generated in the heating part 9. Consequently, the heat storage layer 13 can reduce the time required for increasing the temperature of the heating part 9. As a result, the heat storage layer 13 functions to improve the thermal response characteristics of the thermal head 1. For example, the heat storage layer 13 is formed by applying a predetermined glass paste that is obtained by mixing a suitable organic solvent with glass powder on the upper surface of the substrate 7 by screen printing and the like, and firing the glass paste.

The thick film electrode 16 is provided on the upper surface side of the substrate 7. The thick film electrode 16 is disposed in such a manner as to extend in the main scanning direction along the first long side 7*a* of the substrate 7. The thick film electrode 16 increases the electric capacity of the common electrode 17 provided above.

The resistance layer 15 is provided on the substrate 7 and the heat storage layer 13 in such a manner as to cover the thick film electrode 16. Various electrodes that constitute the head base body 3 are provided on the resistance layer 15. The resistance layer 15 is patterned in the shape similar to the various electrodes that constitute the head base body 3. An exposed area from which the resistance layer 15 is exposed is provided between the common electrode 17 and the individual electrode 19. The exposed area forms a plurality of elements of the heating part 9. The elements that constitute the heating part 9 are arranged on the heat storage layer 13 along the longitudinal direction of the substrate 7. Among the sides of the first surface 7*f* of the substrate 7, the heating part 9 is disposed with a predetermined interval from the first short side 7*c* and the second short side 7*d* along the short direction.

The heating part 9 generates heat according to the electrical signal supplied from the outside, and has a function of thermally transferring ink of an ink sheet (not illustrated) on a recording medium (not illustrated). For example, the elements that constitute the heating part 9 are disposed in the density of 100 dpi (dots per inch) to 2400 dpi or the like. The arrangement of the resistance layer 15 that constitute the heating part 9 is not limited to the one illustrated in the drawing, and may be provided only between the common electrode 17 and the individual electrode 19, for example.

The heating part 9 includes the resistance layer 15, the common electrode 17, and the individual electrode 19, for example. The resistance layer 15 is made of a relatively high electrical resistance material such as tantalum nitride (TaN) based, tantalum silicon oxide (TaSiO) based, tantalum silicon oxynitride (TaSiNO) based, titanium silicon oxide (TiSiO) based, titanium silicon carbonate (TiSiCO) based, niobium silicon oxide (NbSiO) based, or the like. The common electrode 17 and the individual electrode 19 are made of metal such as aluminum (Al) or copper (Cu). When voltage is applied to the resistance layer 15 disposed between the common electrode 17 and the individual electrode 19, the resistance layer 15 is heated by Joule heating.

The common electrode 17 includes main wiring parts 17*a* and 17*d*, an auxiliary wiring part 17*b*, and a lead part 17*c*. The common electrode 17 electrically connects the elements that constitute the heating part 9 with the connector 31. The main wiring part 17*a* extends along the first long side 7*a* of the substrate 7, and is provided above the thick film electrode 16. The main wiring part 17*a* and the thick film electrode 16 are electrically connected via the resistance layer 15. The auxiliary wiring part 17*b* extends along the first short side 7*c* and the second short side 7*d* of the substrate 7. The lead part 17*c* extends individually toward each of the elements that constitute the heating part 9 from the main wiring part 17*a*. The main wiring part 17*d* extends along the second long side 7*b* of the substrate 7.

The individual electrode 19 electrically connects the heating part 9 with the driving IC 11. More specifically, the elements that constitute the heating part 9 are divided into a plurality of groups. The individual electrode 19 electrically connects each of the elements of the heating part 9 that constitute each of the groups with the driving IC 11 corresponding to each of the groups. The driving IC 11 will be described later.

The first connection electrode 21 electrically connects the driving IC 11 with the connector 31. A plurality of the first connection electrodes 21 are connected to each of the driving IC 11, and each of the first connection electrodes 21 includes one or a plurality of wiring lines having different functions.

The ground electrode 4 is surrounded by the individual electrode 19, the first connection electrode 21, and the main wiring part 17*d* of the common electrode 17. The ground electrode 4 is held at a ground potential of 0 to 1 V.

The connection terminal 2 is provided at the second long side 7*b* side of the substrate 7, and connects the common electrode 17, the individual electrode 19, the first connection electrode 21, and the ground electrode 4 with the connector 31. The connection terminal 2 is provided in such a manner as to correspond to the connector pin 8. To connect the connector 31, the connector pin 8 and the connection terminal 2 are connected in such a manner as to be electrically independent from each other.

The second connection electrode 26 electrically connects the adjacent driving ICs 11 with each other. The second connection electrode 26 is provided in such a manner as to correspond to the first connection electrode 21, and transmits various signals to the adjacent driving ICs 11.

For example, the resistance layer 15 and the various electrodes can be formed as below. For example, materials that constitute the resistance layer 15 and the various electrodes are sequentially layered on the heat storage layer 13 using a thin film formation technique such as a sputtering method. The resistance layer 15 and the electrodes are then provided by processing a laminated body into a predetermined pattern using a conventionally known photo-etching and the like. In this manner, the various electrodes are electrically connected to the heating part 9 and the thick film electrode 16, and the thickness of each of the electrodes may be from 0.1 to 1 μm, for example.

For example, the driving IC 11 is disposed on the first surface 7*f* side of the substrate 7. A plurality of the driving ICs 11 are disposed along the arranging direction of the heating part 9 in such a manner as to correspond to the elements of the heating part 9 allocated for each of the driving ICs 11. The driving IC 11 is connected to the other end portion of the individual electrode 19 and one end portion of the first connection electrode 21. The driving IC 11 supplies electric power for individually heating each of the elements of the heating part 9 to the heating part 9, according to the electrical signal supplied from the outside. For example, the driving IC 11 may be a switching member in which a plurality of switching elements is included.

The resin layer 18 is provided on the main wiring part 17*a* of the common electrode 17. The resin layer 18 is provided in such a manner as to cover the thick film electrode 16 in a plan view, and to smooth a level difference generated by the thick film electrode 16.

The hard coat 29 seals the driving IC 11, the individual electrode 19, the second connection electrode 26, and the first connection electrode 21 while the driving IC 11, and the individual electrode 19, the second connection electrode 26, and the first connection electrode 21 are connected with one another. For example, the hard coat 29 may be made of a resin material such as epoxy resin and silicone resin.

The insulation layer 30 is provided in such a manner as to be adjacent to the protection layer 25, which will be described below, and covers a part of the individual electrode 19. More specifically, the insulation layer 30 is provided at the second long side 7*b* side of the substrate 7 than the protection layer 25.

The insulation layer 30 is provided in such a manner as to extend along the main scanning direction, and is provided between the auxiliary wiring part 17*b* close to the first short side 7*c* and the auxiliary wiring part 17*b* close to the second short side 7*d*. For example, the insulation layer 30 is made of resin such as polyimide or silicone resin, and can be manufactured by printing or applying a resin material using a dispenser. The thickness of the insulation layer 30 may be from 10 to 30 μm. The insulation layer 30 is not limited to resin, and may be made by printing or firing glass, for example.

The protection layer 25 is disposed on the heat storage layer 13 formed on the upper surface of the substrate 7, and is a member for covering the heating part 9, the insulation layer 30, the common electrode 17, and the individual electrode 19. More specifically, the protection layer 25 is provided in such a manner as to cover a part of the individual electrode 19 from the edge of the substrate 7, in other words, from the first long side 7*a*, the first short side 7*c*, and the second short side 7*d* of the substrate 7. The end portion of the protection layer at the side surface 7*e* side is disposed on the insulation layer 30.

The protection layer 25 has a laminated structure including a first protection layer 25*a* and a second protection layer 25*b*. The first protection layer 25*a* covers the main wiring part 17*a*, a part of the auxiliary wiring part 17*b*, the lead part 17*c*, the heating part 9, the insulation layer 30, and a part of the individual electrode 19. The first protection layer 25*a* protects the area where the heating part 9, the common electrode 17, and the individual electrode 19 are covered from corrosion due to adhesion of moisture contained in the atmosphere and the like, or from abrasion caused by coming into contact with the recording medium to be printed. The second protection layer 25*b* is provided on the first protection layer 25*a*. The second protection layer 25*b* is formed of a material having a higher abrasion resistance than the first protection layer 25*a*, and for example, protects the heating part 9 from abrasion caused by coming into contact with the recording medium to be printed.

The coating layer 27 is provided in such a manner as to partially cover the common electrode 17, the individual electrode 19, the first connection electrode 21, and the protection layer 25 on or above the substrate 7. The coating layer 27 protects the covered area from oxidation caused by coming into contact with atmosphere, corrosion due to adhesion of moisture contained in the atmosphere, and the like. By covering the end portion of the protection layer 25 in such a manner as to come into close contact with the protection layer 25, for example, the coating layer 27 prevents a failure of the protection layer 25 from being separated from an object to be protected such as the heating part 9 and the various electrodes from occurring. For example, the coating layer 27 is formed of a resin material such as epoxy-based resin, polyimide-based resin, or silicone-based resin. Such resin materials have fluidity before the coating layer 27 is cured and formed.

The coating layer 27 is formed with an opening portion (not illustrated) for exposing the individual electrode 19 and the first connection electrode 21 that are connected to the driving IC 11. These wiring lines are connected to the driving IC 11 via the opening portion. The driving IC 11 is sealed by the hard coat 29 while being connected to the individual electrode 19 and the first connection electrode 21. Consequently, the hard coat 29 protects the driving IC 11 or a connection part between the driving IC 11 and these electrodes. For example, the hard coat 29 is formed of resin such as epoxy resin and silicone resin.

Figure 4:
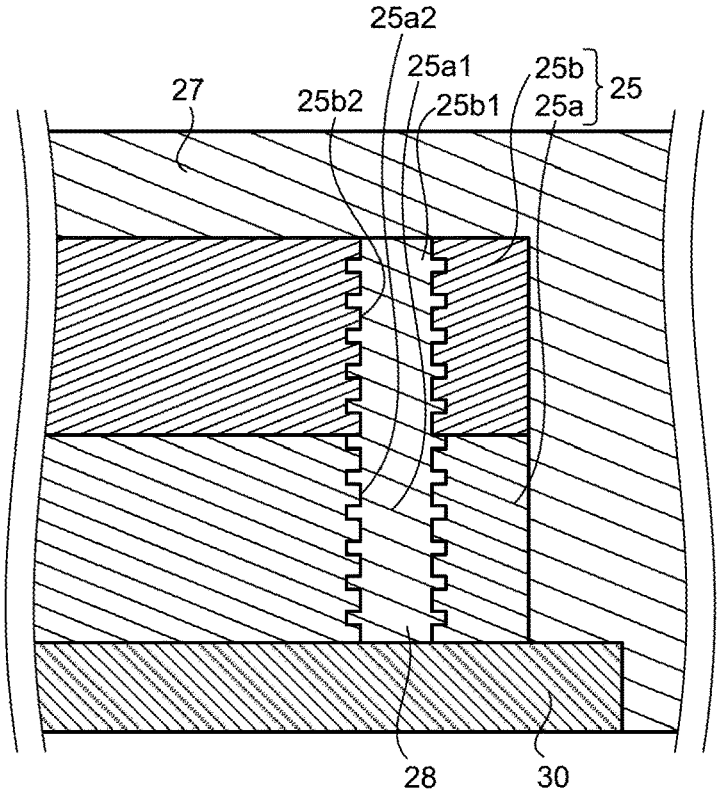
FIG. 4 is a partial enlarged view of FIG. 3.

Hereinafter, the thermal head 1 according to the first embodiment will be described in more detail with reference to FIG. 3 and FIG. 4. FIG. 4 is a partial enlarged view focused on the shape of the protection layer 25 disposed on the insulation layer 30 in the thermal head 1 illustrated in FIG. 3. Although FIG. 4 corresponds to the enlarged view of the portion surrounded by a chain line in FIG. 3, the illustration of the individual electrode 19 disposed below the insulation layer 30 is omitted in FIG. 4.

The thermal head 1 according to the embodiments includes the protection layer 25 provided on the insulation layer 30 and the coating layer 27 provided on the protection layer 25. The protection layer 25 includes the first protection layer 25*a* provided on the insulation layer 30 and the second protection layer 25*b* provided on the first protection layer 25*a*.

The first protection layer 25*a* includes a first recessed part 25*a*1 that penetrates through the first protection layer 25*a* along the thickness direction. For example, the thickness of the first protection layer 25*a* can be made from 3 to 12 μm. The first recessed part 25*a*1 includes an inner wall 25*a*2 having a plurality of recesses and projections. The "recesses and projections" are two or more portions of a part of the inner wall 25*a*2 of the first recessed part 25*a*1 that project or are recessed along the surface direction of the first protection layer 25*a* in such a manner that the shape of the first recessed part 25*a*1 is intermittently different in a plan view, for example. A degree of the inner wall 25*a*2 projecting or recessed in the surface direction of the first protection layer 25*a* relative to the opening of the first recessed part 25*a*1 at the end portion of the inner wall 25*a*2, in other words, at the second protection layer 25*b* side is about 1 to 100 nm, for example. This value is defined as the "size of recesses and projections".

The shape and size of the first recessed part 25*a*1 opened on the upper surface of the first protection layer 25*a* may be the same between the surface side facing the second protection layer 25*b* and the surface side facing the insulation layer 30, or may be different as illustrated in FIG. 4. The average opening diameter of the first recessed part 25*a*1 is not limited, but may be from 0.5 to 1.75 μm, for example. The "average opening diameter" is a median diameter (d50) that is measured using a mercury penetration method and that is obtained on the basis of distribution of bubbles when the first recessed part 25*a*1 is made close to a cylinder.

The second protection layer 25*b* includes a second recessed part 25*b*1 that communicates with the first recessed part 25*a*1 and that penetrates through the second protection layer 25*b* along the thickness direction of the second protection layer 25*b*. For example, the thickness of the second protection layer 25*b* may be from 2 to 15 μm. The second recessed part 25*b*1 has an inner wall 25*b*2 having a plurality of recesses and projections. The opening diameter size of the second recessed part 25*b*1 and the size of recesses and projections in the inner wall 25*b*2 may be substantially the same as the opening diameter size of the first recessed part 25*a*1 and the size of recesses and projections in the inner wall 25*a*2, for example. However, the opening diameter size of the second recessed part 25*b*1 and the size of recesses and projections in the inner wall 25*b*2 may not be necessarily the same as those of the first recessed part 25*a*1.

For example, the material of the first protection layer 25*a* may be silicon nitride (SiN), silicon dioxide ($SiO_2$), silicon oxynitride (SiON), or the like. For example, the material of the second protection layer 25*b* may be titanium nitride (TiN), titanium carbonitride (TiCN), silicon carbide (SiC), SiON, SiN, TaN, TaSiO, or the like. An example of the protection layer 25 having a high abrasion resistance is the protection layer 25 in which the first protection layer 25*a* is formed of SiN and the second protection layer 25*b* is formed of TiN.

For example, the first protection layer 25*a* and the second protection layer 25*b* can be manufactured by an ion plating method using an electron gun or a sputtering method. The first recessed part 25*a*1 and the second recessed part 25*b*1 may be manufactured by etching. The recesses and projections in the inner walls 25*a*2 and 25*b*2 may also be manufactured by etching.

The coating layer 27 is disposed in such a manner as to go around the end portion of the first protection layer 25*a* and the second protection layer 25*b*, and is supporting the first protection layer 25*a* and the second protection layer 25*b* in such a manner that the first protection layer 25*a* and the second protection layer 25*b* are interposed between the coating layer 27 and the insulation layer 30.

The coating layer 27 covers above the second protection layer 25*b* so as to fill the second recessed part 25*b*1. As described above, the resin material forming the coating layer has fluidity before being cured. Consequently, a filled layer 28 filled with a resin material having the same composition as that of the coating layer 27 is formed in the second recessed part 25*b*1 and the first recessed part 25*a*1. The filled layer 28 reaches to the upper surface of the insulation layer 30 from the coating layer 27, and it is possible to bring the first protection layer 25*a* and the second protection layer 25*b* that are disposed in such a manner as to be interposed between the coating layer 27 and the insulation layer 30 further close to each other.

It is also possible to prevent the filled layer 28 from being separated from the first recessed part 25*a*1 and the second recessed part 25*b*1 with the recesses and projections in the inner walls 25*a*2 and 25*b*2 of the respective first recessed part 25*a*1 and the second recessed part 25*b*1 working in a cooperative manner with the filled layer 28. Consequently, with the thermal head 1 according to the first embodiment, it is possible to prevent the protection layer 25 from being separated.

Figure 5:
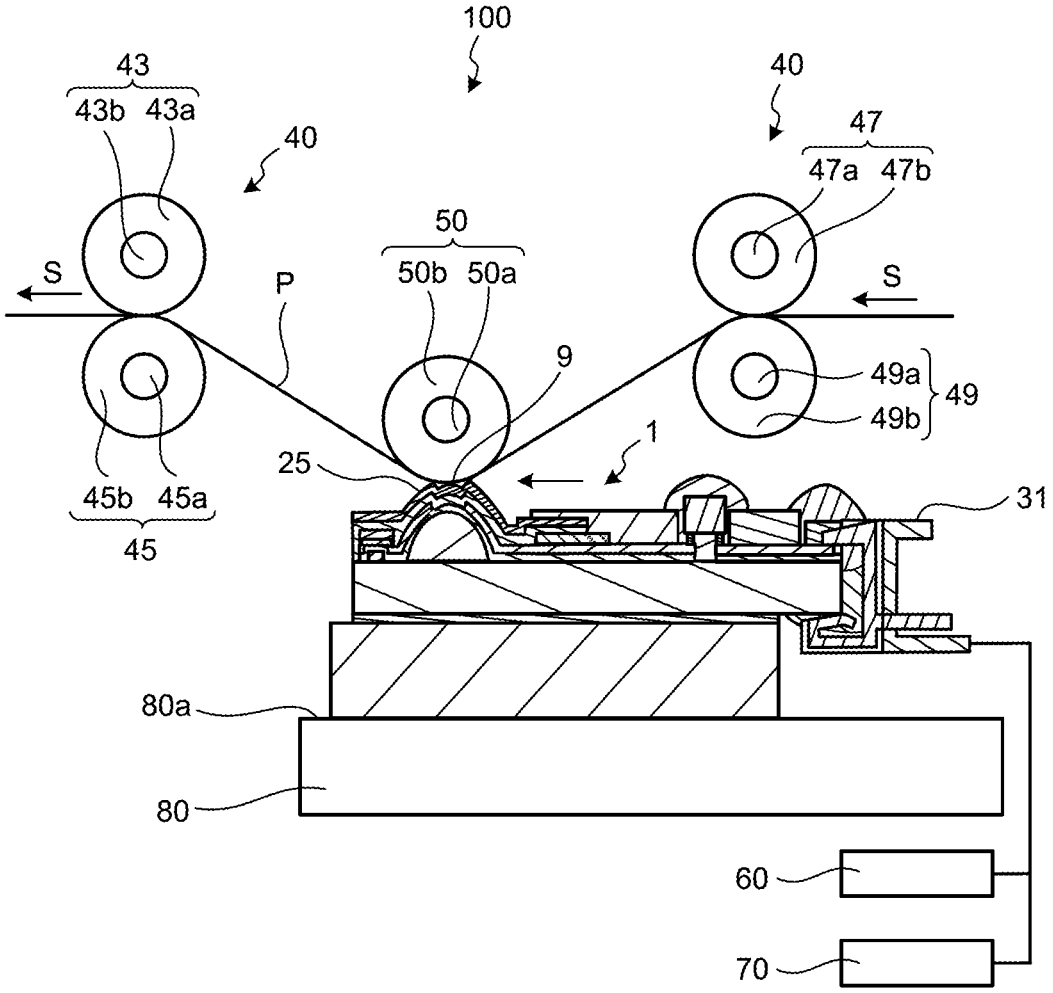
FIG. 5 is a schematic view illustrating a thermal printer according to the first embodiment.

A thermal printer according to the first embodiment will be described with reference to FIG. 5. FIG. 5 is a schematic view illustrating a thermal printer 100 according to the first embodiment.

The thermal printer 100 illustrated in FIG. 5 includes the thermal head 1 described above, a conveyance mechanism 40, a platen roller 50, a power supply device 60, and a control device 70. The thermal head 1 is fitted to a fitting surface 80*a* of a fitting member 80 provided in a housing (not illustrated) of the thermal printer 100. The thermal head 1 is fitted to the fitting member 80 in such a manner that the thermal head 1 is disposed along the main scanning direction orthogonal to a conveyance direction S.

The conveyance mechanism 40 includes a driving module (not illustrated) and conveyance rollers 43, 45, 47, and 49. The conveyance mechanism 40 conveys a recording medium P such as a thermal paper and an image receiving paper to which ink is to be transferred, along the conveyance direction S indicated by an arrow, on or above the protection layer 25 disposed on the heating part 9 of the thermal head 1. The driving module has a function of driving the conveyance rollers 43, 45, 47, and 49, and for example, the driving module may be a motor. For example, the conveyance rollers 43, 45, 47, and 49 may be cylindrical shaft bodies 43*a*, 45*a*, 47*a*, and 49*a* that are formed of metal such as stainless and that are respectively covered by elastic members 43*b*, 45*b*, 47*b*, and 49*b* made of butadiene rubber and the like. For example, when the recording medium P is the image receiving paper to which ink is to be transferred and the like, an ink film (not illustrated) may be transferred with the recording medium P between the recording medium P and the heating part 9 of the thermal head 1.

The platen roller 50 has a function of pressing the recording medium P onto the protection layer 25 placed on the heating part 9 of the thermal head 1. The platen roller 50 is disposed in such a manner as to extend along the main scanning direction, and both end portions of the platen roller 50 are supported and fixed so that the platen roller 50 can rotate while pressing the recording medium P onto the protection layer 25 placed on the heating part 9.For example, the platen roller 50 may be a cylindrical shaft body 50*a* that is formed of metal such as stainless and that is covered by an elastic member 50*b* made of butadiene rubber and the like.

The power supply device 60 has a function of supplying current for heating the heating part 9 of the thermal head 1 and current for operating the driving IC 11 as described above. The control device 70 has a function of supplying a control signal for controlling the operation of the driving IC 11 to the driving IC 11, so as to selectively heating the heating part 9 of the thermal head 1 as described above.

The thermal printer 100 performs predetermined printing on the recording medium P, by selectively heating the heating part 9 using the power supply device 60 and the control device 70, pressing the recording medium P onto the protection layer 25 placed on the heating part 9 of the thermal head 1 using the platen roller 50, and conveying the recording medium P on the protection layer 25 placed on the heating part 9 using the conveyance mechanism 40. When the recording medium P is the image receiving paper and the like, printing on the recording medium P is performed by thermally transferring ink of an ink film (not illustrated) conveyed with the recording medium P, on the recording medium P.

<Second Embodiment>

Figure 6A:
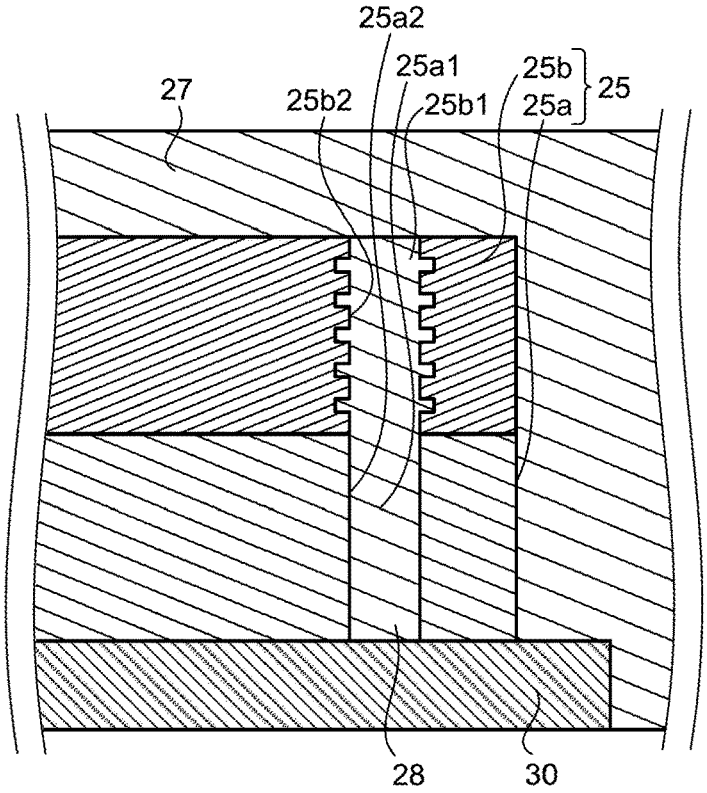
FIG. 6A is a diagram illustrating an outline of a thermal head according to a second embodiment.

The thermal head 1 according to a second embodiment will be described with reference to FIG. 6A. FIG. 6A is a diagram illustrating an outline of the thermal head 1 according to the second embodiment. The thermal head 1 illustrated in FIG. 6A corresponds to the enlarged view of the same portion of the thermal head 1 according to the first embodiment illustrated in FIG. 4. Unless otherwise noted, the same applies to the thermal head 1 according to the other embodiments.

The thermal head 1 illustrated in FIG. 6A has the same configuration as that of the thermal head 1 according to the first embodiment, except that only the second recessed part 25*b*1, out of the first recessed part 25*a*1 and the second recessed part 25*b*1, includes the inner wall 25*b*2 having recesses and projections.

Because only the second recessed part 25*b*1 includes the inner wall 25*b*2 having recesses and projections, the resin material forming the filled layer 28 easily spreads to the upper surface of the insulation layer 30 even when the fluidity is relatively low, for example. The filled layer 28 formed of the resin material that has easily reached the upper surface of the insulation layer 30 from the coating layer 27 can bring the first protection layer 25*a* and the second protection layer 25*b* that are disposed in such a manner as to be interposed between the coating layer 27 and the insulation layer 30 further close to each other. It is also possible to prevent the filled layer 28 from being separated from the first recessed part 25*a*1 and the second recessed part 25*b*1 with the recesses and projections in the inner wall 25*b*2 of the second recessed part 25*b*1 working in a cooperative manner with the filled layer 28. Consequently, with the thermal head 1 according to the second embodiment, it is possible to prevent the protection layer 25 from being separated.

<Modification>

Figure 6B:
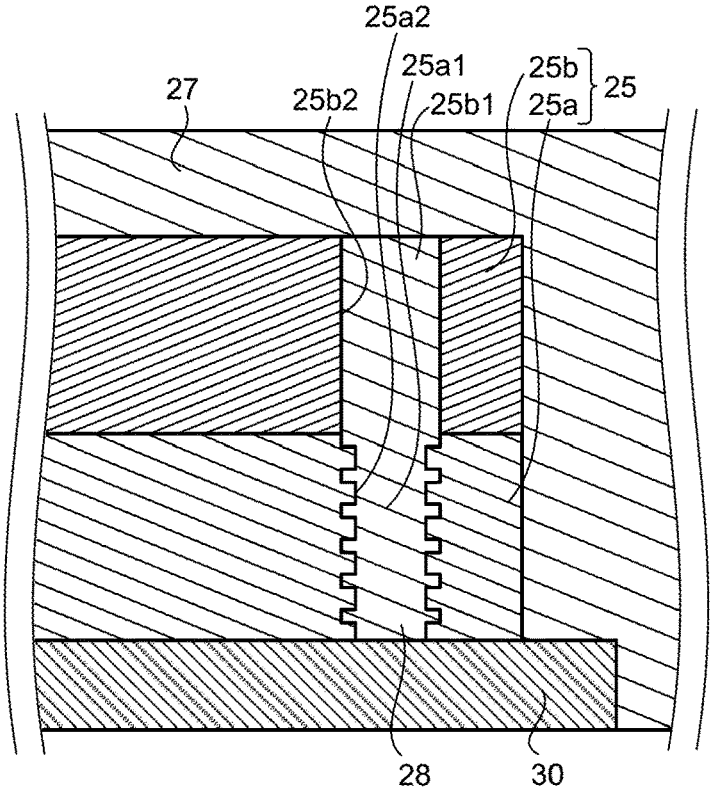
FIG. 6B is a diagram illustrating an outline of a thermal head according to a modification of the second embodiment.

The thermal head 1 according to a modification of the second embodiment will be described with reference to FIG. 6B. FIG. 6B is a diagram illustrating an outline of the thermal head 1 according to the modification of the second embodiment.

The thermal head 1 illustrated in FIG. 6B has the same configuration as that of the thermal head 1 according to the first embodiment, except that only the first recessed part 25*a*1, out of the first recessed part 25*a*1 and the second recessed part 25*b*1, includes the inner wall 25*a*2 having recesses and projections.

The first recessed part 25*a*1 that is disposed at a position further away from the coating layer 27 than the second recessed part 25*b*1 includes the inner wall 25*a*2 having recesses and projections. Consequently, the filled layer 28 formed of the resin material filled to the upper surface of the insulation layer 30 from the coating layer 27 can bring the first protection layer 25*a* and the second protection layer 25*b* that are disposed in such a manner as to be interposed between the coating layer 27 and the insulation layer 30 further close to each other. It is also possible to prevent the filled layer 28 from being separated from the first recessed part 25*a*1 and the second recessed part 25*b*1 with the recesses and projections in the inner wall 25*a*2 of the first recessed part 25*a*1 working in a cooperative manner with the filled layer 28. Consequently, with the thermal head 1 according to the modification of the second embodiment, it is possible to prevent the protection layer 25 from being separated.

<Third Embodiment>

Figure 7:
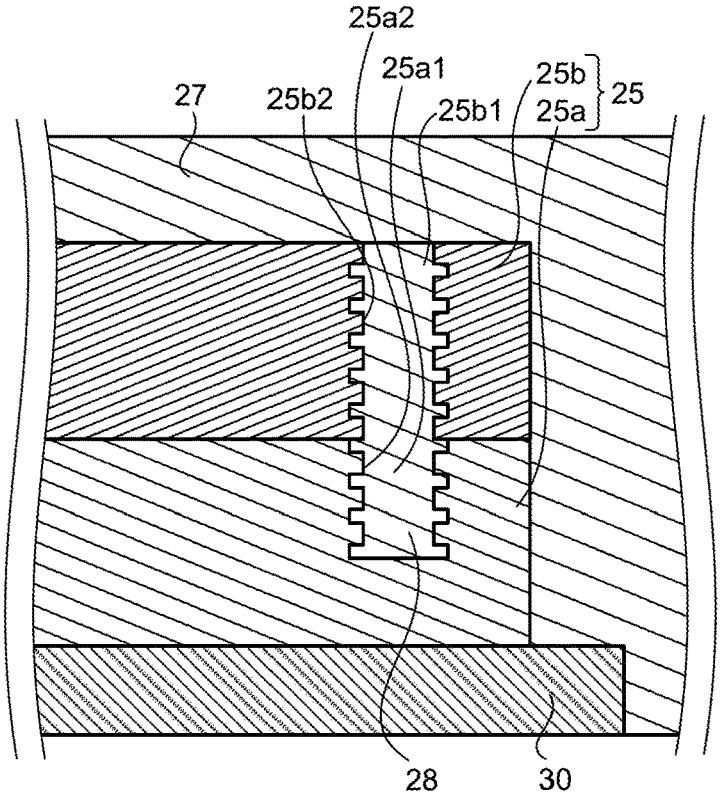
FIG. 7 is a diagram illustrating an outline of a thermal head according to a third embodiment.

The thermal head 1 according to a third embodiment will be described with reference to FIG. 7. FIG. 7 is a diagram illustrating an outline of the thermal head 1 according to the third embodiment.

The thermal head 1 illustrated in FIG. 7 has the same configuration as that of the thermal head 1 according to the first embodiment, except that the first recessed part 25*a*1 does not penetrate through the first protection layer 25*a*. The first recessed part 25*a*1 extends along the thickness direction of the first protection layer 25*a*, and is opened on the upper surface. Consequently, the second recessed part 25*b*1 communicates with the first recessed part 25*a*1, and the filled layer 28 formed of the resin material filled to the bottom surface of the first recessed part 25*a*1 from the coating layer 27 can bring the first protection layer 25*a* and the second protection layer 25*b* firmly close to each other, with the coating layer 27 disposed in such a manner as to go around the outside of the first protection layer 25*a* and the second protection layer 25*b*.

It is also possible to prevent the filled layer 28 from being separated from the first recessed part 25*a*1 and the second recessed part 25*b*1 with the recesses and projections in the inner walls 25*a*2 and 25*b*2 of the respective first recessed part 25*a*1 and the second recessed part 25*b*1 working in a cooperative manner with the filled layer 28. Consequently, with the thermal head 1 according to the third embodiment, it is possible to prevent the protection layer 25 from being separated.

With the thermal head 1 according to the third embodiment, the insulation layer 30 may not be disposed because the first recessed part 25*a*1 does not communicate with the upper surface of the insulation layer 30.

<Fourth Embodiment>

Figure 8A:
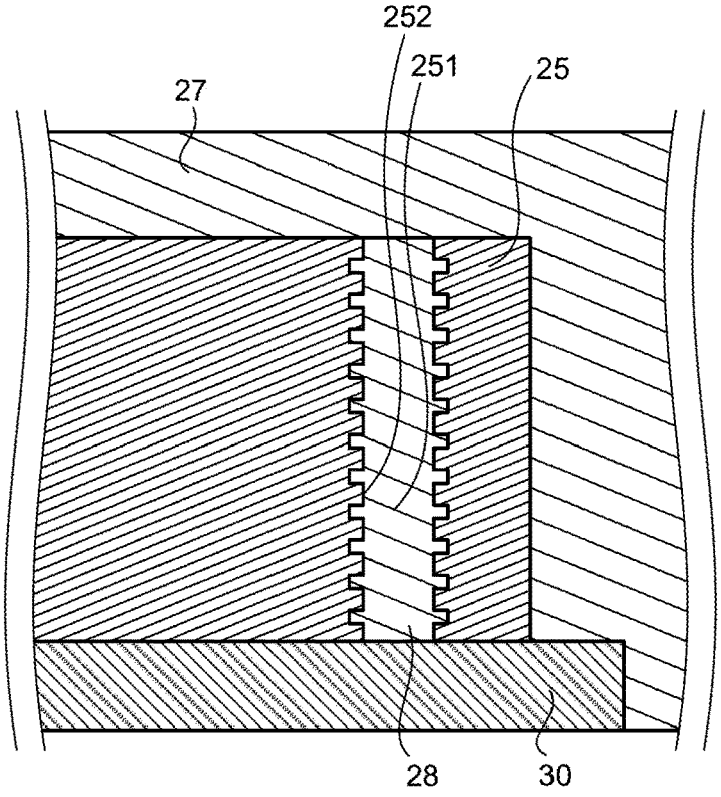
FIG. 8A is a diagram illustrating an outline of a thermal head according to a fourth embodiment.

The thermal head 1 according to a fourth embodiment will be described with reference to FIG. 8A. FIG. 8A is a diagram illustrating an outline of the thermal head 1 according to the fourth embodiment. The thermal head 1 illustrated in FIG. 8A corresponds to the enlarged view of the same portion of the thermal head 1 according to the first embodiment illustrated in FIG. 4.

The thermal head 1 illustrated in FIG. 8A has the same configuration as that of the thermal head 1 according to the first embodiment, except that the protection layer 25 is made of a single layer. More specifically, the protection layer 25 includes an inner wall 252 having recesses and projections and a recessed part 251 penetrating through the protection layer 25 in the thickness direction.

With the thermal head 1 according to the fourth embodiment, by providing the recessed part 251 having recesses and projections in the inner wall 252, it is possible to prevent the protection layer 25 from being separated with the coating layer 27, the filled layer 28, and the recesses and projections in the inner wall 252 working in a cooperative manner.

<Modification>

Figure 8B:
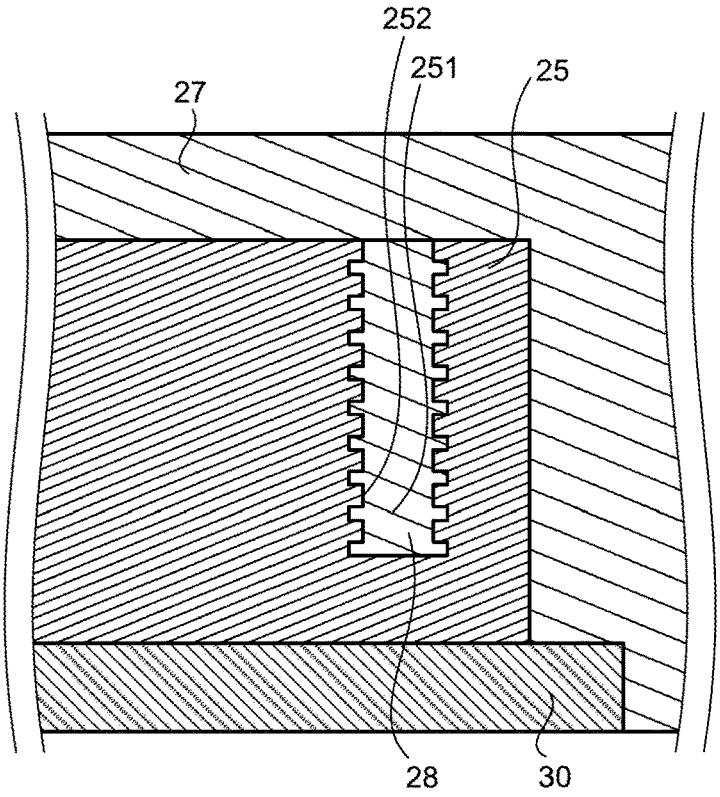
FIG. 8B is a diagram illustrating an outline of a thermal head according to a modification of the fourth embodiment.

The thermal head 1 according to a modification of the fourth embodiment will be described with reference to FIG. 8B. FIG. 8B is a diagram illustrating an outline of the thermal head 1 according to a modification of the fourth embodiment.

The thermal head 1 illustrated in FIG. 8B has the same configuration as that of the thermal head 1 according to the fourth embodiment, except that the recessed part 251 does not penetrate through the protection layer 25.

With the thermal head 1 according to the modification of the fourth embodiment, by providing the recessed part 251 having recesses and projections provided in the inner wall 252, it is possible to prevent the protection layer 25 from being separated with the coating layer 27, the filled layer 28, and the recesses and projections in the inner wall 252 working in a cooperative manner.

<Fifth Embodiment>

Figure 9:
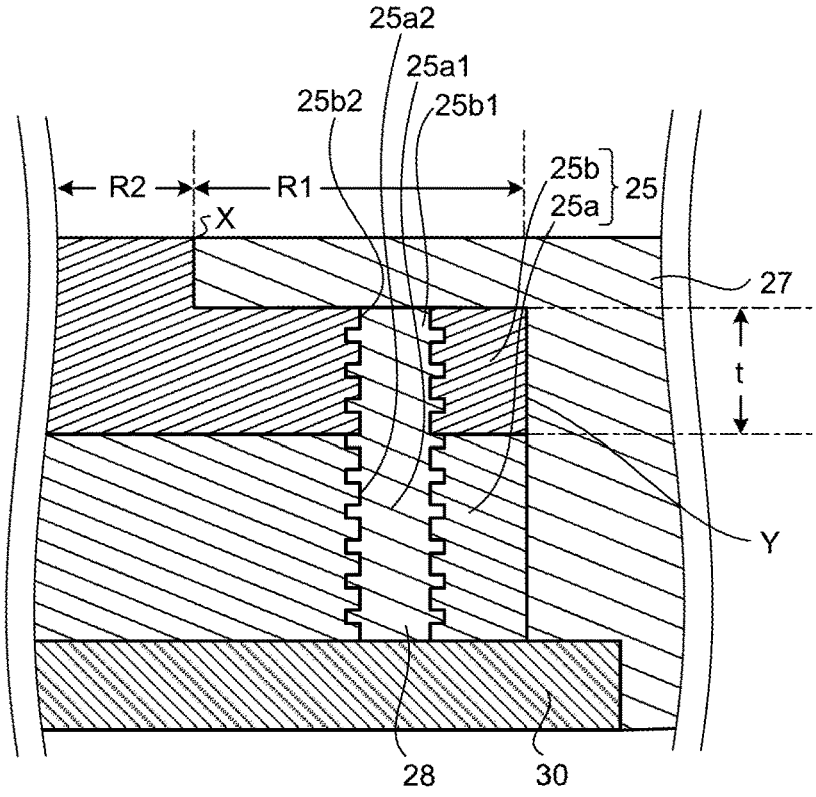
FIG. 9 is a diagram illustrating an outline of a thermal head according to a fifth embodiment.

The thermal head 1 according to a fifth embodiment will be described with reference to FIG. 9. FIG. 9 is a diagram illustrating an outline of the thermal head 1 according to the fifth embodiment.

The thermal head 1 illustrated in FIG. 9 has the same configuration as that of the thermal head 1 according to the first embodiment, except that the shape of the second protection layer 25*b* and the disposition of the coating layer 27 are different. More specifically, the second protection layer 25*b* includes a first region R1 that is a region covered by the coating layer 27 and a second region R2 that is a region not covered by the coating layer 27. The thickness of the second protection layer 25*b* in the first region R1 disposed at the end portion of the side surface 7*e* side of the substrate 7 is smaller than that in the second region R2, and the second recessed part 25*b*1 is provided in the first region R1.

The coating layer 27 is disposed in such a manner as to cover the second recessed part 25*b*1, and it is possible to prevent the protection layer 25 from being separated as the thermal head 1 according to the other embodiments described above. The height of the coating layer 27 to the upper surface of the coating layer 27 from the substrate 7 can be held low, because the coating layer 27 is disposed only in the first region R1. Consequently, with the thermal printer 100 including the thermal head 1 according to the fifth embodiment, for example, it is possible to prevent the coating layer 27 from being separated caused by coming into contact with the recording medium P, and prevent the protection layer 25 from being separated caused by the contact between the recording medium P and the coating layer 27.

In this example, the "end portion" of the second protection layer 25*b* is a region from an end surface Y of the second protection layer 25*b* to a border X placed closer to the center as much as the length of about 10%, relative to the total length of the second protection layer 25*b* extending in the short direction of the substrate 7, for example. A thickness t of the second protection layer 25*b* in the first region R1 may be made equal to or less than 1 μm, for example.

In FIG. 9, the thickness of the second protection layer 25*b* is changed at the border X between the first region R1 and the second region R2. However, it is also possible to configure in such a manner that the thickness of the second protection layer 25*b* changes in a stepwise manner so as to incline toward the end surface Y from the border X, for example.

In this manner, the embodiments of the present disclosure have been described. However, the present disclosure is not limited to the embodiments described above, and various modifications may be made without departing from the scope of the present application. For example, the thermal printer 100 using the thermal head 1 according to the first embodiment is illustrated. However, it is not limited thereto, and the thermal head 1 according to the embodiments and modifications may be applied in the thermal printer 100. A plurality of the thermal heads 1 in the embodiments may also be combined.

A thin-film head with a thin heating part 9 is illustrated as an example, by forming the resistance layer 15 into a thin film. However, it is not limited thereto. A thick-film head with a thick heating part 9 may be applied by forming the resistance layer 15 thick, after patterning various electrodes.

In the example, the heating part 9 is a plane head formed on the first surface 7*f* of the substrate 7. However, the heating part 9 may be an edge head formed on the end surface of the substrate 7.

The sealing member 12 may also be formed of the same material used for the hard coat 29 covering the driving IC 11. In this case, the hard coat 29 and the sealing member 12 may be formed at the same time, by printing in a region where the sealing member 12 is formed when the hard coat 29 is printed.

In the embodiments described above, the first and second recessed parts 25*a*1 and 25*b*1 respectively formed on the first and second protection layers 25*a* and 25*b* include the filled layer 28 made of a filled resin material. However, it is not limited thereto. For example, the resin material forming the coating layer 27 may be disposed inside the first and second recessed parts 25*a*1 and 25*b*1, and a gap may be provided in a part of the first and second recessed parts 25*a*1 and 25*b*1. For example, when the resin material is disposed inside the first and second recessed parts 25*a*1 and 25*b*1 in such a manner that the resin material continues from the filled layer 28, it is possible to prevent the protection layer 25 from being separated with the resin material inside the first and second recessed parts 25*a*1 and 25*b*1 working in a cooperative manner with the filled layer 28.

In the embodiments described above, the first and second recessed parts 25*a*1 and 25*b*1 are respectively formed on the first and second protection layers 25*a* and 25*b*. However, it is not limited thereto, and a plurality of the first and second recessed parts 25*a*1 and 25*b*1 may be formed on each of the first and second protection layers 25*a* and 25*b*. In this case, the first and second recessed parts 25*a*1 and 25*b*1 having different configurations may be provided in such a manner as to combine two or more of the embodiments described above. In the embodiments described above, the first and second recessed parts 25*a*1 and 25*b*1 are formed on the end portions of the first and second protection layers 25*a* and 25*b*. However, it is not limited thereto, and for example, the first and second recessed parts 25*a*1 and 25*b*1 may be disposed on the center portion of the first and second protection layers 25*a* and 25*b*.

In the embodiments described above, the protection layer 25 has a single layer structure or a double layer structure. However, it is not limited thereto, and the protection layer 25 may have a structure in which three or more layers are laminated.

Additional advantages and modifications may readily be derived by those skilled in the art. Therefore, the broader aspects of the present disclosure are not limited by the specific details and the representative embodiments illustrated and described as above. Accordingly, various modifications are possible without departing from the spirit and scope of the general inventive concept as defined by the appended claims and the equivalents.

The invention claimed is:

1. A thermal head, comprising:
a substrate;
a heating part placed on or above the substrate;
an electrode placed on or above the substrate and connected to the heating part;
a protection layer placed on or above the heating part and the electrode; and
a coating layer placed on or above the electrode and the protection layer, and made of a resin material, wherein
the protection layer includes a recessed part that is opened on an upper surface and that extends along a thickness direction of the protection layer, and
the recessed part includes an inner wall having a plurality of recesses and a plurality of projections, and the resin material is disposed inside the recessed part.

2. The thermal head according to claim 1, further comprising:
an insulation layer provided between the electrode and the protection layer, wherein
the recessed part penetrates through the protection layer along the thickness direction of the protection layer.

3. The thermal head according to claim 1, wherein
the protection layer includes
a first protection layer that has a first recessed part opened on an upper surface, and
a second protection layer that has a second recessed part penetrating through the second protection layer along a thickness direction, and that is provided between the first protection layer and the coating layer in such a manner that the second recessed part communicates with the first recessed part.

4. A thermal printer, comprising:
the thermal head according claim 1;
a conveyance mechanism configured to convey a recording medium on or above the protection layer placed on the heating part; and
a platen roller configured to press the recording medium onto the protection layer placed on the heating part.

5. A thermal head, comprising:
a substrate;
a heating part placed on or above the substrate;
an electrode placed on or above the substrate and connected to the heating part;
a protection layer placed on or above the heating part and the electrode; and
a coating layer placed on or above the electrode and the protection layer, and made of a resin material, wherein
the protection layer includes:
a recessed part that is opened on an upper surface and that extends along a thickness direction of the protection layer,
a first protection layer that has a first recessed part opened on an upper surface, and
a second protection layer that has a second recessed part penetrating through the second protection layer along a thickness direction, and that is provided between the first protection layer and the coating layer in such a manner that the second recessed part communicates with the first recessed part, and
the recessed part includes an inner wall having a plurality of recesses and projections, and the resin material is disposed inside the recessed part.

6. The thermal head according to claim 5, wherein only the second recessed part, out of the first recessed part and the second recessed part, includes the recesses and projections in the inner wall.

7. The thermal head according to claim 5, wherein
the second protection layer includes a first region covered with the coating layer and a second region not covered with the coating layer, and
the second protection layer in the first region has a smaller thickness than thickness of the second protection layer in the second region.

8. The thermal head according to claim 5, wherein the second recessed part is formed at a portion where the second protection layer has a thickness that is equal to or less than 1 μm.

9. The thermal head according to claim 5, wherein the second protection layer has a larger conductivity than conductivity of the first protection layer.

10. The thermal head according claim 5, wherein
the second protection layer includes a first region covered with the coating layer and a second region not covered with the coating layer, and
the first region is formed at an end portion of the second protection layer.

* * * * *